US007818870B1

(12) United States Patent
Pinson

(10) Patent No.: US 7,818,870 B1
(45) Date of Patent: Oct. 26, 2010

(54) METHOD OF INLINE SPLITTING STABILIZED SLAB STEEL DURING CONTINUOUS CASTING

(75) Inventor: Michael F. Pinson, Cincinnati, OH (US)

(73) Assignee: Wright Bros., Inc., Cincinnati, OH (US)

( * ) Notice: Subject to any disclaimer, the term of this patent is extended or adjusted under 35 U.S.C. 154(b) by 1195 days.

(21) Appl. No.: 11/437,893

(22) Filed: May 19, 2006

Related U.S. Application Data

(60) Provisional application No. 60/683,421, filed on May 23, 2005.

(51) Int. Cl.
*B21B 1/46* (2006.01)

(52) U.S. Cl. ..... 29/527.6

(58) Field of Classification Search ..... 29/527.6, 29/527.5, 412, 415; 266/61, 48, 62
See application file for complete search history.

(56) References Cited

U.S. PATENT DOCUMENTS 7,378,051 B2 * 5/2008 Alexin ..... 266/61

* cited by examiner

*Primary Examiner*—John C Hong
(74) *Attorney, Agent, or Firm*—Neal O. Willmann

(57) ABSTRACT

Described herein is a method of splitting slabs of steel produced by the continuous casting process. Molten steel, molded into strands proceeds on rollers where it is formed and cut transversely into individual slabs. Then, according to the method described herein, each individual slab is split lengthwise by the coordination of a pair of cutting torches positioned medially over the stabilized slab, each torch moving from each end of the slab and coordinated to complete the longitudinal cut and return to its original position to await the next slab and continue the splitting of slabs into more manageable units.

8 Claims, 2 Drawing Sheets

METHOD OF INLINE SPLITTING STABILIZED SLAB STEEL DURING CONTINUOUS CASTING

CROSS-REFERENCE TO RELATED APPLICATION

This application claims the benefit of the filing date of U.S. Provisional Application No. 60/683,421 filed May 23, 2005.

FIELD OF THE DISCLOSURE

Continuous casting is a part of the steel making process wherein molten steel is solidified into manageable or marketable units such as billets, blooms or slabs, which are processed further in finishing mills. Hereinafter, billets, blooms and slabs will be referred to as "slabs," or in the singular, to simplify the description of the disclosed improvement in the continuous casting process.

To begin the process, steel from an electric or oxygen furnace is tapped into a ladle and taken to a continuous casting machine. The ladle is elevated over a tundish and poured into the tundish from which it flows into a water-cooled copper mold to form a strand having a solid outer shell and liquid core.

Upon exiting the mold, the strand enters a roller containment area where the strand is cooled by water and air to promote solidification. Once the strand is fully solidified, it is cut, transversely, by torch or mechanical shears, into individual pieces, i.e., the aforementioned billets, blooms and slabs, depending on the casting machine or mold design. Then, depending on the shape or grade, the slab is placed in intermediate storage, hot charged for finished rolling or sold as a semi-finished product.

SUMMARY OF THE DISCLOSURE

The improvement in the continuous casting method described herein involves further cutting, more specifically, longitudinally splitting, and the cast steel product to facilitate further processing. More precisely, the disclosed procedure involves the coordinated use of a pair of cutting torches situated medially, over the roller area, to longitudinally split a slab into a more manageable unit.

DESCRIPTION OF THE PREFERRED EMBODIMENT

Figure 1:
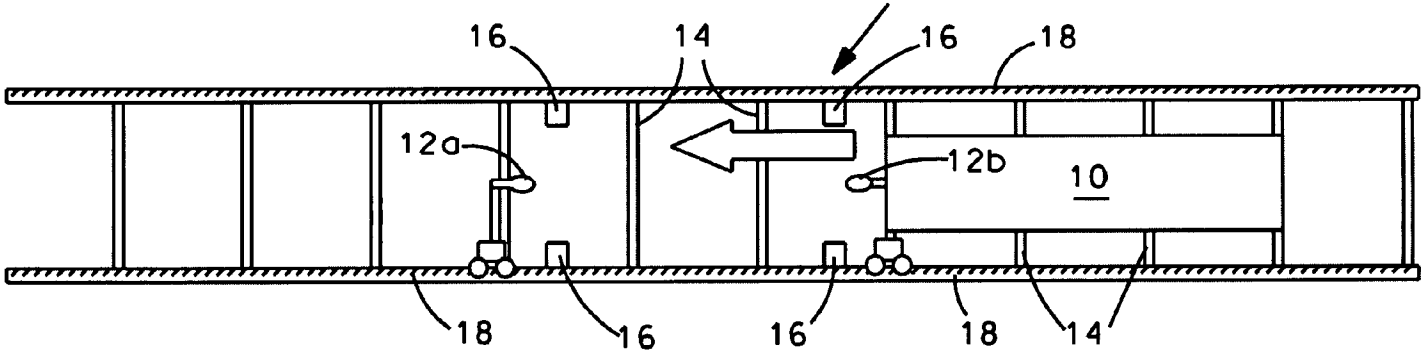
FIG. 1 is a schematic depiction of paired cutting torches in their original position awaiting the appropriate placement of a slab of steel.
Figure 2:
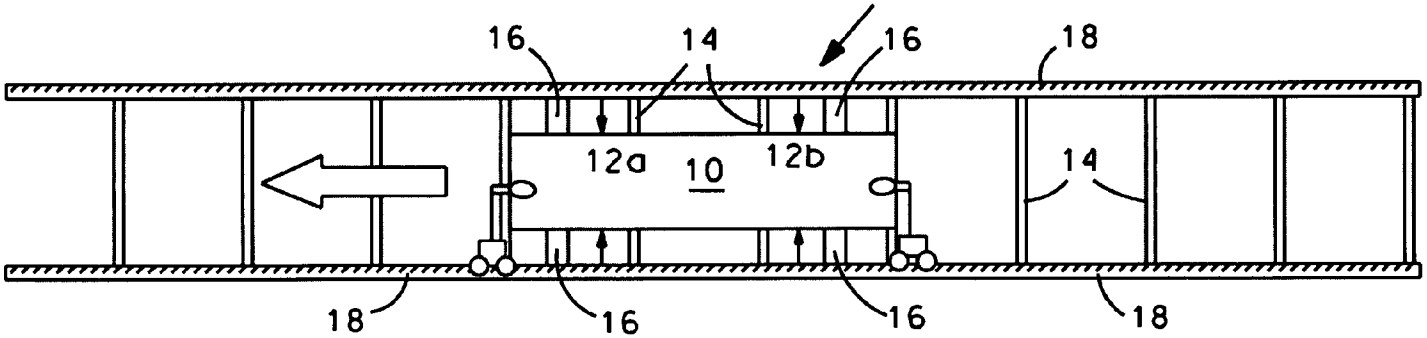
FIG. 2 is a schematic depiction of a slab of steel, positioned and stabilized between paired cutting torches.
Figure 3:
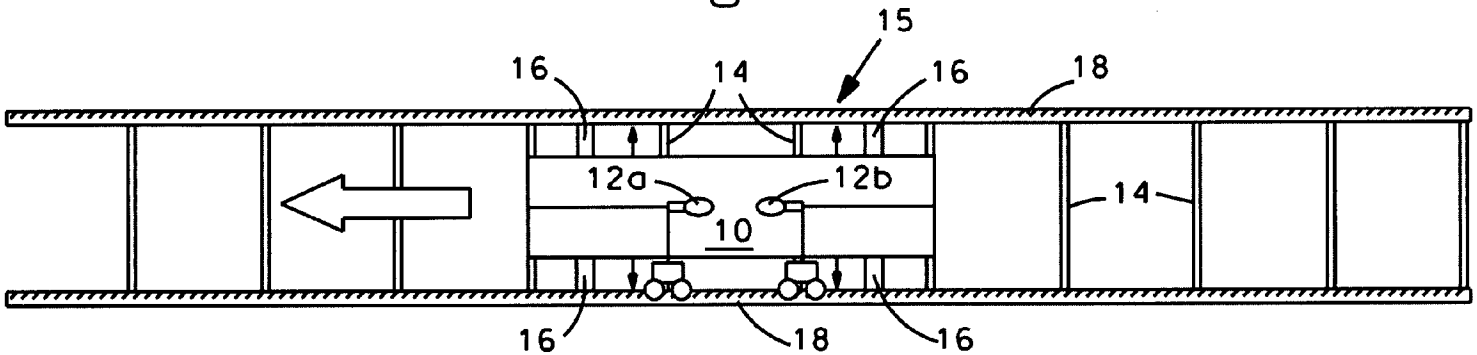
FIG. 3 is a schematic depiction of paired cutting torches coordinated and aligned to cut an assigned length of the slab. And, FIG. 4 is a schematic depiction of paired cutting torches returned to their original positions to await the next slab to be longitudinally severed.
Figure 4:
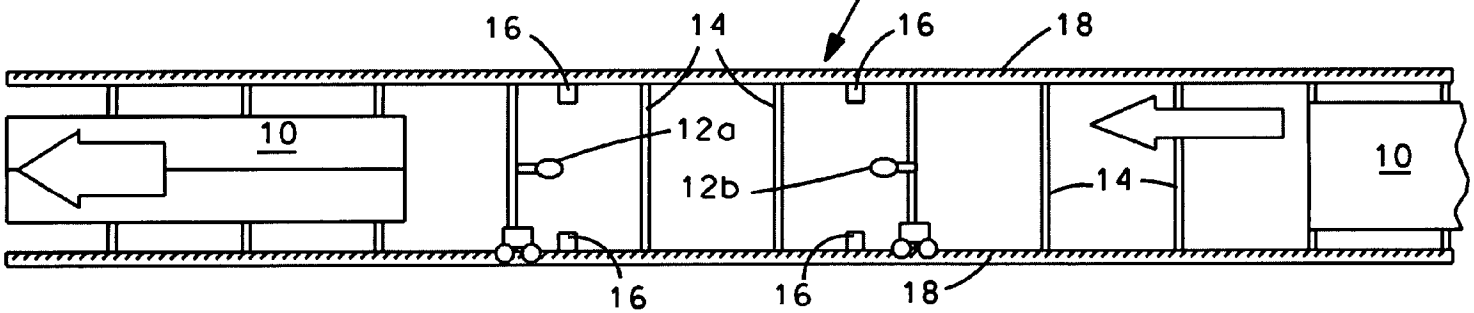

Essentially, what is depicted and described herein is a novel method for splitting slabs of steel produced during the continuous casting process. The slab and torch speeds depicted in the drawing are intended to illustrate an embodiment of the disclosed process and are not intended to define the disclosed process. Slab steel 10 is split longitudinally by a pair of cutting torches 12*a*, 12*b* positioned medially over said slab, thus facilitating handling and final processing. More specifically, the process according to the depicted method involves stopping, stabilizing and positioning newly formed steel slab while paired torches are engaged and positioned to split the stabilized slab. After splitting the slab, the torches are returned to their home or original positions and the split slabs are rolled to the finishing or stacking areas.

In the current preferred embodiment illustrated in the drawing, the casting speed of the process and the movement of the slab of steel are 42 inches per minute. This, of course, is a typical and preferred casting speed, but it is neither definitive nor a limitation of the disclosed process.

Positioned parallel to the rollers of the casting process is a track assembly 18. The track assembly supports a pair of cutting torches. These torches are positioned medially and above the slabs proceeding through the roller area and spaced or separated by a distance approximately equal to the length of the steel slab. Typically, the torches are oxy-fuel cutting torches independently mounted on the track assembly to permit variable forward and backward speeds for each of the two torches. The torches also have the ability to move laterally in order to avoid encountering and impacting each other, especially during recovery when one torch is returned to the original position to await the next slab while the other paired torch continues cutting to complete the splitting of the slab.

More specifically, in phase #1, the slab is stopped upstream of the cutting station. When ready, the slab is moved to the cutting station (phase #2). The slab is centered using hydraulic mechanisms 16, and the paired torches are moved from the home positions to either end of the slab. Currently, the hydraulic mechanism engages the stabilized slab and elevates it above the rollers so that the tales of the torches inflict minimal damage to the rollers.

In phase #3, the slab is split longitudinally, each of the paired torches cutting toward the middle of the slab. After the slab is split, the hydraulic mechanism lowers the two sections of the original slab to the roller surface. At the end of the cutting procedure (phase #4), one torch is retracted while the other finishes the cut, thus avoiding a collision of torches. Finally, the second torch is returned to its home position and the split slab proceeds to the end of the strand.

Generally speaking, the speeds of the two torches are determined by the size of the slab being split. And, by equipping the torches with a tip that handles oxygen at more than 200 psi and by fueling with propylene, even faster cutting speeds and greater productivity are possible. And, while propylene is clearly the preferred fuel gas, other fuel gases such as natural gas, methacetylene, acetylene and propane also perform adequately when employed in the disclosed method.

Additionally, when splitting slabs produced by the continuous casting method, the cutting table rollers 14 in the fire of the torches must selectively drop down (ducking rolls) to allow the torches to cut over them while others continue to support the weight of the slab. It would not be unexpected if additional cutting tables 15 were needed to support the slab being split, depending on the size of the slab and the cutting speed. It is also envisioned at this juncture in the development of the disclosed invention that a specially designed roller, having spaced and/or staggered and cantilevered rollers to accommodate the flame of the cutting torches would be developed and deployed to support and transport the slabs during the splitting process. For example, these specially designed rollers would typically feature "spacers" having reduced diameters to allow for the perpendicular passage of cutting torches without impacting and cutting the rollers. It is also envisioned that the a roller bed assembly could be devised whereby every other roller in the roller bed in the splitting area be higher on one side to allow the two slabs of the split slab to move independently.

Furthermore, the location of the dross pit that collects the oxidized steel from the splitting cut will also need to be reconfigured to accommodate the longitudinal cut.

The implementation of the disclosed method of inline splitting will permit steel plants utilizing the continuous casting method to dramatically increase the production and processing of slab steel. And if for any reason the disclosed method of coordinated splitting cannot be implemented in the casting area of the mill, the same technique employing coordinated paired torches could also be used in the finishing area of the mill.

While the foregoing is a detailed and complete description of the preferred embodiments of the disclosed method of inline slab splitting, it should be apparent that numerous variations and modifications can be made and employed to implement the all-important purpose of the disclosed method without departing from the spirit of the invention, which is fairly defined by the appended claims.

The invention claimed is:

1. A method of splitting slab steel which comprises: receiving on cutting table rollers a slab of steel transversely cut from a strand of steel produced by the continuous casting process;

stopping said rollers and stabilizing the progression of said slab;

positioning a pair of cutting torches medially over each transversely-cut end of said stabilized slab so that each torch is aligned to cut said slab along the same longitudinal line;

cutting said slab longitudinally from each end of said slab;

withdrawing one of said paired cutting torches to its original position before the slab is severed;

allowing the remaining cutting torch to continue cutting said slab until said slab is severed; and withdrawing the remaining cutting torch to its original position.

2. The method according to claim 1 wherein the cutting table rollers selectively drop down to avoid the cutting torches.

3. The method according to claim 1 wherein the cutting torches are fueled with propylene.

4. The method according to claim 1 wherein the cutting torches are fueled with propane.

5. The method according to claim 1 wherein the slab is stabilized using hydraulic mechanisms.

6. The method according to claim 1 wherein the paired cutting torches are mounted on a track assembly parallel to the cutting table rollers.

7. The method according to claim 1 wherein the slab is a billet.

8. The method according to claim 1 wherein the slab is a bloom.

* * * * *